United States Patent [19]

Kando

[11] Patent Number: 4,756,079

[45] Date of Patent: Jul. 12, 1988

[54] SLIDE FASTENER CLOSING APPARATUS

[75] Inventor: Akiyoshi Kando, Uozu, Japan

[73] Assignee: Yoshida Kogyo K. K., Tokyo, Japan

[21] Appl. No.: 38,664

[22] Filed: Apr. 15, 1987

[30] Foreign Application Priority Data

Apr. 15, 1986 [JP] Japan ..... 61-56289[U]

[51] Int. Cl.[4] ..... A41H 37/06

[52] U.S. Cl. ..... 29/768; 29/33.2; 29/409

[58] Field of Search ..... 29/33.2, 409, 766, 768, 29/770; 24/419, 420, 429

[56] References Cited

U.S. PATENT DOCUMENTS

| | | | |
|---|---|---|---|
| 4,466,168 | 8/1984 | Hatagishi | 29/768 X |
| 4,520,544 | 6/1985 | Morita et al. | 29/766 X |
| 4,570,335 | 2/1986 | Hatagishi | 29/33.2 X |
| 4,580,326 | 4/1986 | Kawakami et al. | 29/409 |
| 4,592,135 | 6/1986 | Kando | 29/766 |
| 4,606,100 | 8/1986 | Yunoki et al. | 29/33.2 |
| 4,616,539 | 10/1986 | Horikawa | 83/42 |
| 4,625,398 | 12/1986 | Kando | 29/768 |
| 4,707,901 | 11/1987 | Fröhlich | 29/766 X |

FOREIGN PATENT DOCUMENTS

| | | | |
|---|---|---|---|
| A10109643 | 3/1984 | European Pat. Off. . | |
| 2006563 | 6/1983 | Fed. Rep. of Germany | 29/766 |
| 2424110 | 4/1979 | France . | |
| 50-113342 | 9/1975 | Japan . | |
| 50-113343 | 9/1975 | Japan . | |
| 54-41940 | 12/1979 | Japan . | |
| 61-55817 | 4/1986 | Japan . | |

*Primary Examiner*—P. W. Echols
*Assistant Examiner*—Andrew E. Rawlins
*Attorney, Agent, or Firm*—Hill, Van Santen, Steadman & Simpson

[57] ABSTRACT

A slide-fastener closing apparatus, for moving opposed stringers relative to a slider, includes upper and lower feed rollers coactive to move the stringers in either direction along a feed path, and an arrester normally urged to project into the feed path. After the stringers with the slider are supplied forwardly past the arrester, the two rollers are driven to move the stringers rearwardly so that the slider is caught by the arrester until the slide fastener is fully closed. Then the rollers are reversely driven to move the closed slide fastener forwardly for discharging.

4 Claims, 6 Drawing Sheets

SLIDE FASTENER CLOSING APPARATUS

BACKGROUND OF THE INVENTION

1. Field of the Invention

The present invention relates to an apparatus for automatically closing a slide fastener into a final product form for delivery to the market.

2. Description of the Prior Art

A typical prior art apparatus of this character is disclosed in Japanese Laid-Open patent publication No. 60-180515 (corresponding to U.S. Pat. No. 4,592,135), which apparatus comprises a holder including a presser-foot arranged to hold under pressure a slide fastener, which has been assembled by an associated finishing station and partly closed by a slider, temporally in station any position on an track of its travel, and a drive means engageable with and moving the slider to close the slide fastener along its entire length. Such apparatus further includes an air-cylinder to drive the holder and another to reciprocate the drive means and is therefore not only bulky in size but it also difficult to adjust the operational timing between the two cylinders. It has a further problem in that because the slide fastener is immovably pressed down while the slider is pulled forcibly to run along the rows of fastener coupling elements, there is a fear of injuring the coupling elements, the slider or the drive means.

SUMMARY OF THE INVENTION

It is therefore a primary object of the present invention to provide an improved apparatus for automatically closing a slide fastener which will eliminate or alleviate the aforementioned disadvantages of the prior art.

A more specific object of the invention is to provide an apparatus for automatically closing a slide fastener which essentially comprises a pair of feed rollers rotative both in forward and reverse directions to move a slide fastener, and a slider arrester engageable with and arresting a slider in position to provide continued movement of the fastener therethrough, all operating parts being actuated by a power essentially dependent upon moments applied by feed rollers to the slide fastener. The apparatus as a whole is therefore made relatively compact and eleminates a fear of damage to the slider, fastener coupling elements or operating parts of the apparatus.

The above and other objects and features of the invention will become clear from the following detailed description taken in conjunction with the accompanying drawings in which like reference numerals refer to like and corresponding parts.

DETAILED DESCRIPTION OF THE PREFERRED EMBODIMENT

Figure 1:
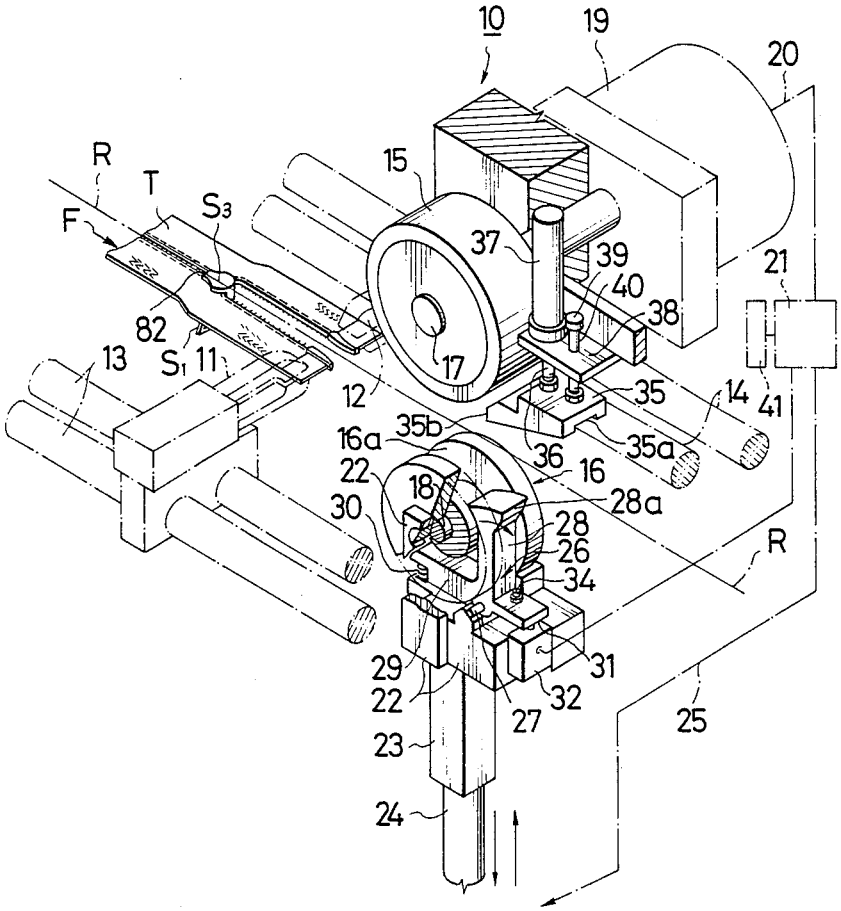
FIG. 1 is a perspective view of an apparatus for automatically closing a slide fastener embodying the invention.
Figure 4A:
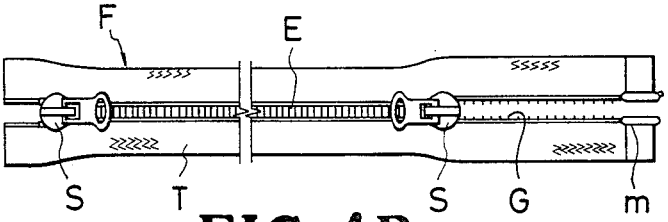
FIGS. 4A and 4B are plan views of slide fasteners of a separable type.

Referring now to FIG. 1, there is shown an apparatus 10 provided in accordance with the invention for automatically closing an individual slide fastener F finished by but partly open and transferred from a fastener assembling or finishing unit not shown. The slide fastener F that may be handled by the present apparatus 10 may be of a standard form shown in FIGS. 5A and 5B or of a separable type shown in FIGS. 4A and 4B, each slide fastener commonly including a pair of stringers or tapes T carrying along their inner longitudinal edges rows of coupling elements E which are taken into and out of mutual coupling engagement by a slider S as the latter reciprocates between top and bottom end stops M in a manner well known in the art. When a chain of slide fasteners F is assembled with sliders S and then end stop M, there necessarily occurs a gap G (FIG. 4A) or a length of uncoupled or separated rows of fastener elements E between the slider mounted thereon and the end stops, which gap G must be closed to provide an acceptable slide fastener product prior to its shipment. It is to this end that the apparatus 10 of the invention is applied.

Each individual slide fastener F is transported along a horizontal path of travel R—R from the assembling unit to the apparatus 10 by a suitable transporting means which is illustrated in FIG. 1 to be in the form of a pair of grippers 11, 12 movable along their guide rods 13, 14.

The apparatus 10 includes an upper feed or drive roller 15 and a lower feed or driven roller 16 disposed in confronting relation to each other across a path of travel R—R of a slide fastener and mounted on their respective shafts 17 and 18 extending at right angles across the path of travel R—R, the rollers 15 and 16 peripherally centrally registering with the path R—R. The upper feed roller 15 has its shaft 17 connected to and driven by a suitable drive such as a reversible motor 19 which is connected via a control circuit 20 to and controlled for its direction of rotation by a controller unit 21.

The lower feed roller 16 has its shaft 18 rotatably supported in a bracket 22 for an elevator block 23 secured to a support rod 24 which is hydraulically driven by means not shown to move vertically. Actuation of the rod 24 is electrically controlled by the controller unit 21 which transmits signals via a circuit 25 to cause ascending and descending of the rod 24 to bring the lower feed roller 16 into and out of peripheral engagement with the upper feed roller 15.

In the embodiment of the invention shown in the present drawings, the lower feed roller 16 is provided with a peripheral guide groove **16*a* dimensioned to allow unobstructed passage of the slider S with its pull tab S1 dependent while the slide fastener F is fed between the upper and lower rollers 15 and 16. In a mode of operation in which the slide fastener F is fed with the slider pull tab S1 face up in contrast to the present showing, the peripheral guide groove may be provided in the upper feed roller 15 for similar purposes. It will be also understood that where a given slider is bulky to protrude on both sides of the fastener F, the guide groove may be provided for each of the two feed rollers 15 and 16**.

A slider arrester 26 is pivotally supported on a pin 27 secured to the bracket 22, the pin 27 extending parallel with the shafts 17, 18 of the rollers 15, 16. The slider arrester 26 has an inverted-L shape defined by a vertical arm 28 and a horizontal arm 29. The vertical arm 28 has at its distal end a hook 28*a* engageable with the slider S to arrest the movement of the latter during the fastener closing operation hereafter described.

A spring 30 is supported between the bracket 22 and the distal end of the horizontal arm 29 to normally urge the slider arrester 26 clockwise in the direction of forward movement of the slide fastener F.

A contact strip 31 extends horizontally from the arrester 26 at an end of the horizontal arm 29 remote from the spring 30 and is normally held in contact with a microswitch 32 on the bracket 22 as the arrester 26 is normally urged clockwise. The contact strip 31 is provided with an adjusting bolt 33 and nut 34 which restrict and adjust the rotary movement of the arrester 26, which takes place as shown in FIGS. 2A–2E.

A presser foot 35 is provided in a position registering with the path of travel R—R immediately downstream of the slider arrester 26 and adapted to hold down the slide fastener F, for which purpose the presser foot 35 is connected to and vertically moved by a piston 36 of a hydraulic cylinder 37 mounted on a frame member 38. The amount of downward movement of presser foot 35, or the downward stroke of the piston 36 is limited by a central nut 39 on the upper end of a bolt 40 inserted through the frame member 38 and secured at the lower end to the presser foot 35 as the control nut 39 is brought into abutting engagement with the upper surface of the frame member 38. The presser foot 35 has in its sole a longitudinal guide groove 35*a* extending throughout its entire length for receiving and passing the reverse side of the slider S during movement of the slide fastener F. The presser foot 35 is tilted downwardly toward the lower feed roller 16 so that its tilted end 35*b* alone is disposed for engagement with the stringer tapes T as shown in FIG. 2C and further with the rear end of the slider upper flange S2 without interference upon the coupling elements E as shown in FIG. 2D.

The tilted end 35*b* of the presser foot 35 is disposed barely out of juxtaposed relation to and spaced a predetermined distance apart from the hook 28*a* of the arrester 26 when the slider S is arrested so that the tilted end 35*b* and the hook 26*b* come into contact precisely with the rear ends of the upper and lower slider flanges S2 and S3 respectively without engaging and impairing the coupling elements E.

Figure 2A:
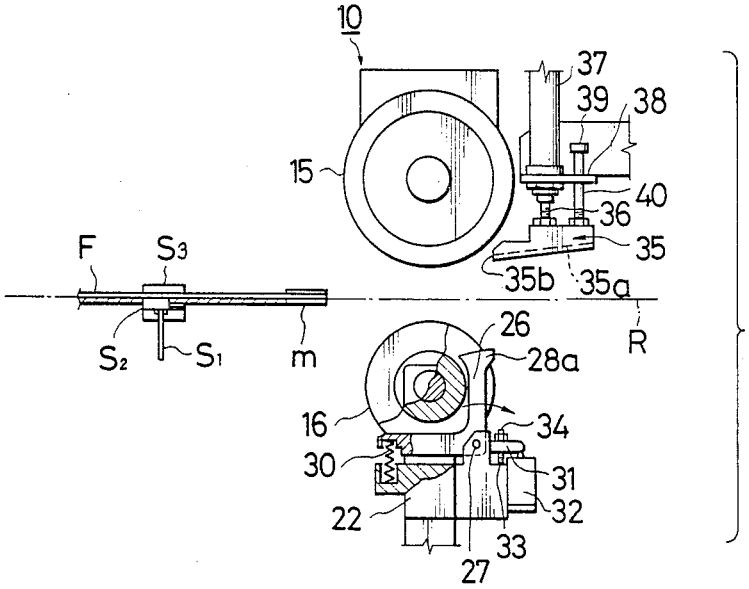
FIGS. 2A–2E inclusive are schematic side elevational, partly sectional, views of the apparatus of FIG. 1 utilized to depict the sequence of its operation.
Figure 2B:
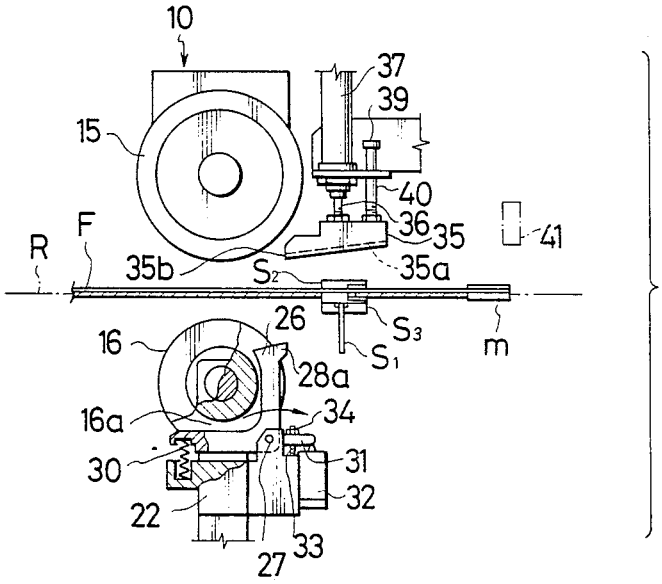
Figure 2C:
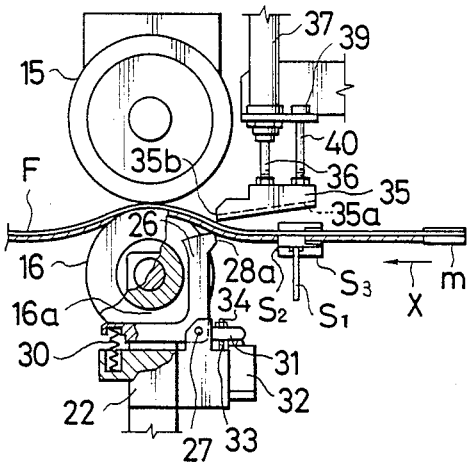
Figure 2D:
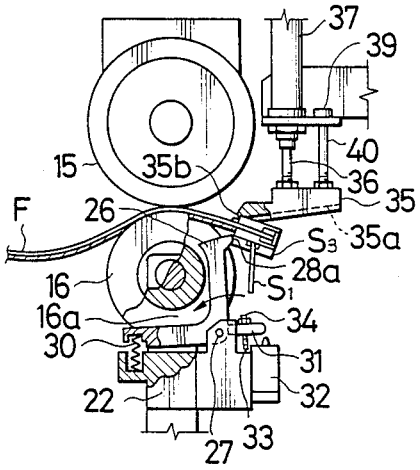

With this construction, the apparatus 10 performs the phases of operation illustrated in FIGS. 2A–2E. In the initial phase or rest position in which the apparatus 10 is disposed as shown in FIG. 1 and FIG. 2A, the feed rollers 15 and 16 and the presser foot 35 are all retracted away from the path of travel R—R of the slide fastener F which has been carried by the grippers 11, 12 to a position immediately adjacent the entrance of the apparatus 10.

Figure 2E:
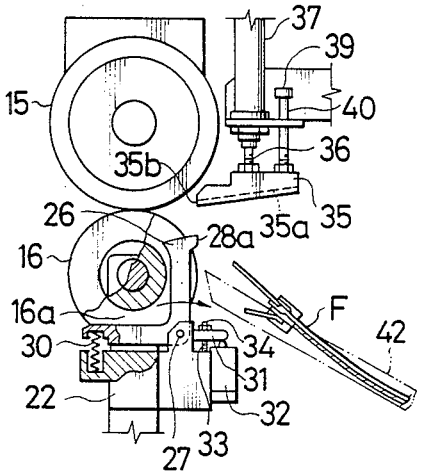
Figure 4B:
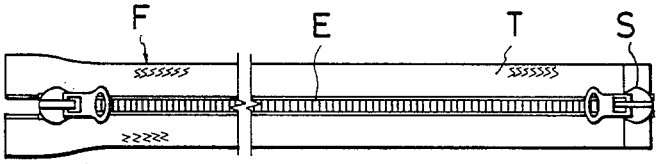
Figure 5A:
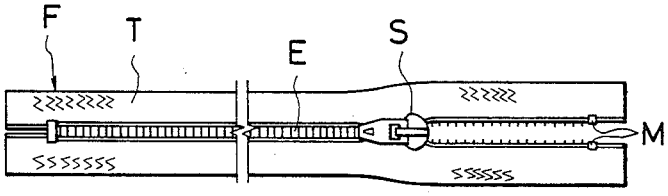
FIGS. 5A and 5B are plan views of slide fasteners of a standard form.
Figure 5B:
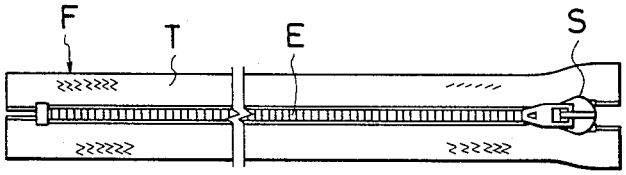

In the second phase of operation shown in FIG. 2B, the slide fastener F has arrived between the upper and lower feed rollers 15 and 16 and the slider S has just passed between the presser foot 35 and the arrester 26, when this is detected by a photoelectric senser 41 connected to the controller unit 21, whereupon a control signal is transmitted via the circuit 25 to cause actuation of the hydraulic drive means to raise the rod 24 and its associated elevator 23 to bring the lower feed roller 16 up close to the upper feed roller 15. This takes place simultaneously with actuation of the cylinder 37 to lower the presser foot 35 to the position shown in FIG. 2C in which the slide fastener F is arrested between the presser foot 35 and the arrester 26. This timing (or the third phase) is detected by suitable means not shown, whereupon the controller unit 21 transmits a signal via a circuit 20 to reverse the direction of rotation of the motor 19 thereby switching the rotation of the upper feed roller 15 from counterclockwise to clockwise. This causes movement of the slide fastener F in the opposite direction (as indicated by the arrow X in FIG. 2C) until the slider S is caught by and between the presser foot 35 and the arrester 26 and thereafter brought into engegement with the end stops M, taking the rows of elements E at the gap G or the separated portions of the stringer tapes T into coupling engagement, thus fully closing the slide fastener F as shown in FIG. 2D or FIGS. 4B and 5B. This, the fourth phase of operation, is followed by the final phase in which the slider arrester 26 is urged against the tension of the spring 30 to pivot counterclockwise under contact pressure from the slider S which has just struck the end stops M and the contact strip 31 disengages from the microswitch 32 whereupon a signal representing the completion of relative movement between the fastener F and the slider S is transmitted from the controller 21 via the circuit 20 to the motor 19 to effect rotation of the upper feed roller 15 counterclockwise so that the fully closed fastener F is now moved back in its forward direction until it is finally hopped out through a discharge chute 42 as shown in FIG. 2E. Discharge of the slide fastener F as now fully closed is detected by suitable means not shown to send a signal to the controller 21 which will instruct the apparatus 10 to resume its initial position shown in FIG. 1 or FIG. 2A, thus standing by for the next repetitive cycle of operation.

Figure 3:
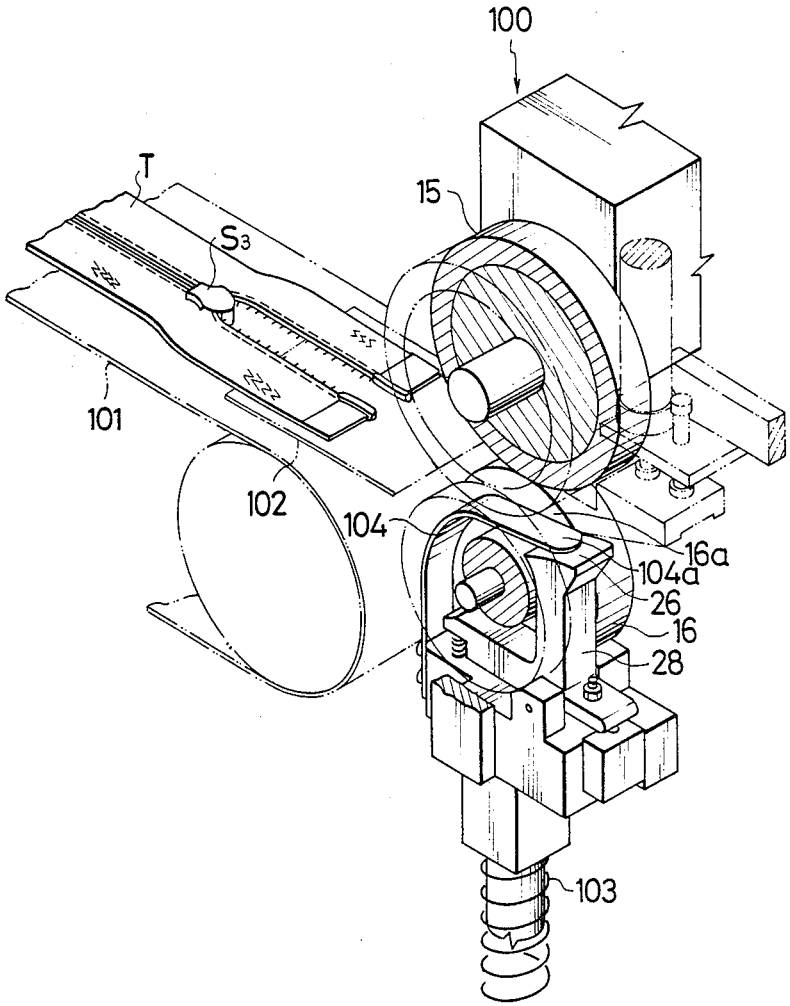
FIG. 3 is a perspective view of a modified form of apparatus according to the invention.

FIG. 3 illustrates a modified form of apparatus 100 in which there is provided an endless belt conveyor 101 in place of the grippers 11, 12 for transporting the slide fastener F to be fully closed, and a plate member 102 is disposed extending between the belt conveyor 101 and the nip of the feed rollers 15 and 16 for relaying the slide fastener F on to the region of the apparatus 100. The lower feed roller 16 in this modification is normally urged by a coil spring 103 upwardly toward the upper feed roller 15 to grip and move the slide fastener F in a manner similar to the operation of the apparatus 10 shown in FIG. 1. There is also additionally provided a protective crank arm 104 secured at one end to the bracket 22 and received in the guide groove 16*a* of the lower roller 16, the free end 104*a* extending over and slightly spaced from the hook 28*a* of the arrester 26. The crank arm 104 is adapted to protect the guide groove 16*a* and the arrester 26 against interference with the slider S and its pull tab S1. The modified apparatus 100 of FIG. 3 is otherwise identical with the apparatus 10.

Having thus described the invention, it will be understood that various changes or modifications may be made in the apparatus 10, (100) without departing from the scope of the appended claims. For example, the microswitch 32 may be replaced by a photoelectric cell. The pivotal movement of the arrester 26 on the pin 27 can be effected by means of a coil spring spanning between the pin 27 and the bracket 22. It is even conceivable that the pressure foot 35 and its associated parts may be excluded from the slide fastener closing operation if a given slider is heavy enough to keep the fastener down and ensure its engagement with the arrester

26. While the invention has been described as applied to the case where the apparatus 10, (100) is located downstream of and associated with existing slide fastener assembling or finishing units, it may be applied immediately in advance of the packaging of product fasteners.

What is claimed is:

1. An apparatus for automatically closing a slide fastener having a pair of stringers and a slider, which apparatus comprises:

(a) an upper feed roller and a lower feed roller driving the slide fastener therebetween and mounted on their respective shafts extending at right angles across a horizontal path of travel of the slide fastener, at least one of said rollers having a peripheral guide groove for unobstructed passage of the slide fastener;

(b) a drive means for driving one of said rollers in either direction;

(c) a control means for controlling said drive means for its direction of rotation;

(d) an arrester means disposed in said path of travel and engageable with the slider for arresting the slider to thereby move the latter relative to the stringers;

said arrester means bieng pivotable and spring-biased normally in the direction of forward travel of the slide fastener; and further including a protective means disposed within said guide groove and extending over said arrester means.

2. An apparatus for automatically closing a slide fastener having a pair of stringers and a slider, said apparatus comprising:

(a) upper and lower feed rollers coactive to feed the slide fastener along horizontal path and mounted on their respective shafts extending across the path at right angles thereto, at least one of said upper and lower feed rollers having a peripheral guide groove for unobstructed passage of the slider;

(b) a reversible motor for driving one of said upper and lower feed rollers in either direction;

(c) a controller unit opratively connected to said motor for controlling its direction of rotation;

(d) a slider arrester pivotally supported on a pin extending parallel to said shafts of said upper and lowr feed rollers, said arrester being received in said peripheral guide groove of said one feed roller and having a hook engageable with the slider for blocking the latter while the slide fastener is being moved rearwardly as the direction of rotation of said motor is reversed;

(e) a presser foot disposed forwardly of said arrester and vertically movable toward the path of the slide fastener for holding the slide fastener against said arrester; and (f) means operatively connected to said controller unit for moving said one feed roller toward and away from the other feed roller.

3. An apparatus according to claim 2, further including a contact strip associated with said arrester; and a microswitch connected to said controller unit, said contact strip being responsive to the pivotal movement of said arrester to engage said switch for effecting forward movement of the slide fastener and to disengage from said switch upon completion of the slide fastener closing operation.

4. An apparatus according to claim 2, further including a protective crank arm disposed within said peripheral guide groove of said one feed roller and having a free end extending over and spaced from said hook of said arrester for protecting said guide groove and said arrester against interference with the slider and its pull tab.

* * * * *